US006666032B1

(12) United States Patent
Rickson et al.

(10) Patent No.: US 6,666,032 B1
(45) Date of Patent: Dec. 23, 2003

(54) THERMALLY INSULATED CONTAINER

(75) Inventors: Colin David Rickson, Bucks (GB); John Bernard Pring, Herts (GB)

(73) Assignee: Kryotrans Limited (GB)

( * ) Notice: Subject to any disclaimer, the term of this patent is extended or adjusted under 35 U.S.C. 154(b) by 0 days.

(21) Appl. No.: 10/019,704

(22) PCT Filed: Jun. 27, 2000

(86) PCT No.: PCT/GB00/02314

§ 371 (c)(1),
(2), (4) Date: May 3, 2001

(87) PCT Pub. No.: WO01/02268

PCT Pub. Date: Jan. 11, 2001

(30) Foreign Application Priority Data

Jul. 1, 1999 (GB) ..... 9915265

(51) Int. Cl.[7] ..... F25B 21/02
(52) U.S. Cl. ..... 62/3.6; 62/3.7
(58) Field of Search ..... 62/3.2, 3.6, 3.3, 62/3.7

(56) References Cited

U.S. PATENT DOCUMENTS 4,383,414 A * 5/1983 Beitner ..... 62/3.6
4,627,242 A * 12/1986 Beitner ..... 62/3.6
5,158,690 A * 10/1992 Batchelder et al. ..... 210/176
5,301,508 A * 4/1994 Kahl et al. ..... 62/3.6
5,319,937 A * 6/1994 Fritsch et al. ..... 62/302
5,505,046 A * 4/1996 Nelson et al. ..... 62/3.6
5,605,047 A * 2/1997 Park et al. ..... 62/3.6
5,725,294 A * 3/1998 Froelicher ..... 312/400
5,946,919 A * 9/1999 McKinney et al. ..... 62/3.7
5,950,450 A * 9/1999 Meyer et al. ..... 62/457.9
5,987,892 A * 11/1999 Watanabe et al. ..... 62/3.6
6,038,865 A * 3/2000 Watanabe et al. ..... 62/3.6

FOREIGN PATENT DOCUMENTS

| | | | | |
|---|---|---|---|---|
| DE | 196 32 880 A1 | | 2/1998 | |
| EP | 0 718 212 A1 | | 6/1996 | |
| GB | 2 225 847 B | | 6/1990 | |
| GB | 2 331 838 A | | 6/1999 | |
| JP | 359044819 A | * | 3/1984 | ..... 118/725 |
| JP | 401260255 A | * | 10/1988 | ..... 236/49.1 |
| WO | WO 97/47174 | | 12/1997 | |

* cited by examiner

*Primary Examiner*—William E. Tapolcai
*Assistant Examiner*—Mohammad M. Ali
(74) *Attorney, Agent, or Firm*—Fay, Sharpe, Fagan, Minnich & McKee, LLP

(57) ABSTRACT

A thermally insulated container includes a payload volume (36) that, in use, is to be maintained within a predetermined temperature range, at least one heat reservoir (44, 54), and a control device (48, 58) for controlling the flow of heat between the payload volume (36) and the heat reservoir (44, 54) so as to maintain the temperature in the payload volume (36) within the predetermined range.

17 Claims, 4 Drawing Sheets

THERMALLY INSULATED CONTAINER

The present invention relates to a thermally insulated container. In particular, but not exclusively, the invention relates to a transit container for transporting temperature sensitive items, that is equipped with "area-under-the curve" technology.

Thermally insulated containers are used to transport items that are sensitive to temperature and must therefore be maintained within predetermined temperature ranges. Such items include goods such as vaccines and drugs, human organs for transplant, tissue cultures, chilled and frozen foods and many other products, some of which have an extremely high value and are very sensitive to temperature changes. It is essential that such products are maintained within the appropriate temperature ranges during transportation.

This can, however, be a difficult task. Although such goods are normally transported within highly insulated containers, sometimes with hot or cold "dogs" (heat reservoirs) to provide additional heating or cooling, heat will still flow into or out of the container, according to the difference between the ambient temperature and the internal temperature of the container. It cannot always be predicted what temperatures will be experienced or how long they will last. If the container is exposed to excessively high or low temperatures for extended periods, the internal temperature may go outside the required range, causing damage to the contents.

A further problem arises in relation to certain live products, such as tissue cultures (for example artificial skin grafts) that are sustained on a nutrient-containing agar. Such products have to be maintained within a fairly narrow temperature range (typically 21–30C) to survive. However, the rate at which they consume the nutrients in the agar also depends on the temperature, increasing as the temperature rises. Therefore, if the temperature remains at the upper end of the acceptable range, the nutrients will be consumed more quickly than if it is at the lower end of that range. In fact, the nutrients may last twice as long at 21C than at 30C. Thus, for maximum life it is desirable to maintain the temperature as close as possible to the bottom end of the acceptable range, while always staying within that range.

A similar problem arises in relation to certain vaccines which degrade at a rate that depends on ambient temperature. As the rate of degradation increases with temperature. It is desirable to maintain the temperature as close as possible to the bottom end of the acceptable range (e.g. 2° C.–4° C.), while always staying within that range. In this way, the rate of degradation can be minimised.

Another problem with existing insulated containers is that they are generally extremely bulky and not reusable. Their use is not therefore environmentally sound and can lead to major storage and waste disposal problems.

One solution to this problem is of course to use a container that has a built in refrigeration or heating system that is operated by a thermostat to maintain the required internal temperature. However, running a refrigeration or heating system requires a large input of energy and generally such containers are only suitable for use where there is an external power supply They therefore require specialised handling and are not suitable for delivery by normal freight services or for delivering relatively small quantities of goods, such as drugs or vaccines to doctors.

GB2331938 describes a refrigerated container that uses a solid-state Peltier-effect thermoelectric nodule for cooling/heating which is controlled by solid-state temperature-sensing and control modules.

It is an object of the present invention to provide an insulated container that mitigates at least some of the aforementioned disadvantages.

According to the present invention there is provided a thermally insulated container including a payload volume that, in use is to be maintained within a predetermined temperature range it least one heat reservoir and a control device for controlling the flow of heat between the payload volume and the heat reservoir so as to maintain the temperature in the payload volume within the predetermined range.

The heat reservoir may be either hotter than the predetermined temperature range to serve as either a heat source compensating for heat lost to the surroundings or cooler than the predetermined temperature range to serve as a heat sink compensating for heat gained from the surroundings.

The Container automatically compensates for unexpected variations in the ambient temperature ensuring that the contents are maintained at the correct temperature. As it is entirely self-contained, an external power source is not required, allowing it to be delivered by normal delivery services. Nor is a large internal energy supply required, since the container is extremely well insulated to minimise heat transfer, and the heat reservoir or reservoirs have sufficient heat capacity to maintain the products at the required temperature for a considerable time.

Advantageously, the control device includes an external temperature sensor for measuring the ambient temperature. Advantageously, the control device includes an internal temperature sensor for measuring the temperature in the payload volume. Advantageously, the control device extrapolates for the measured temperature or temperatures the rate of transfer of heat to or from the container. By measuring the external and/or internal temperatures, the amount of heating/cooling required can be calculated. Preferably, the amount of heat transferred to and from the box is integrated over time, so that the heating/cooling capacity of the heat reservoir is used only when required. We refer to this as "area-under-the-curve" technology.

Advantageously, the control device includes a thermoelectric device for controlling the flow of heat between the payload volume and the heat reservoir. The thermoelectric device may, for example, be a Peltier cell. Alternatively, a mechanical or electro-mechanical device may be used.

Advantageously, the heat reservoir includes a substance that changes state during use to liberate or absorb heat, thereby utilising the large latent heat capacity of the substance.

Advantageously, the heat reservoir includes a first substance for absorbing heat during use from the payload volume, and a second substance that liberates heat during use to the payload volume, so allowing for both heating and cooling as required.

Advantageously, the heat reservoir includes a first substance that changes state during use to liberate heat, and a second substance that chances state during use to absorb heat.

Advantageously, the control device is arranged to bias the temperature in the payload volume towards the lower end of the predetermined range, so maximising the lifetime of products such as live cultures that are sustained by a nutrient-containing agar, or temperature-sensitive vaccines.

Advantageously, the container includes a recording device for recording the temperature in the payload volume, thereby providing means for checking that the contents of the container have been maintained at the required temperature. The recording device may be arranged to calculate from the recorded temperature the remaining lifetime of products transported in the payload volume.

Advantageously, the container has the form of a sealable, thermally insulated box. Advantageously, the box is reusable, thereby reducing waste and alleviating storage problems, and may be substantially transparent to x-rays in at least one direction.

Embodiments of the invention will now be described with reference to the accompanying drawings, in which.

Figure 1:
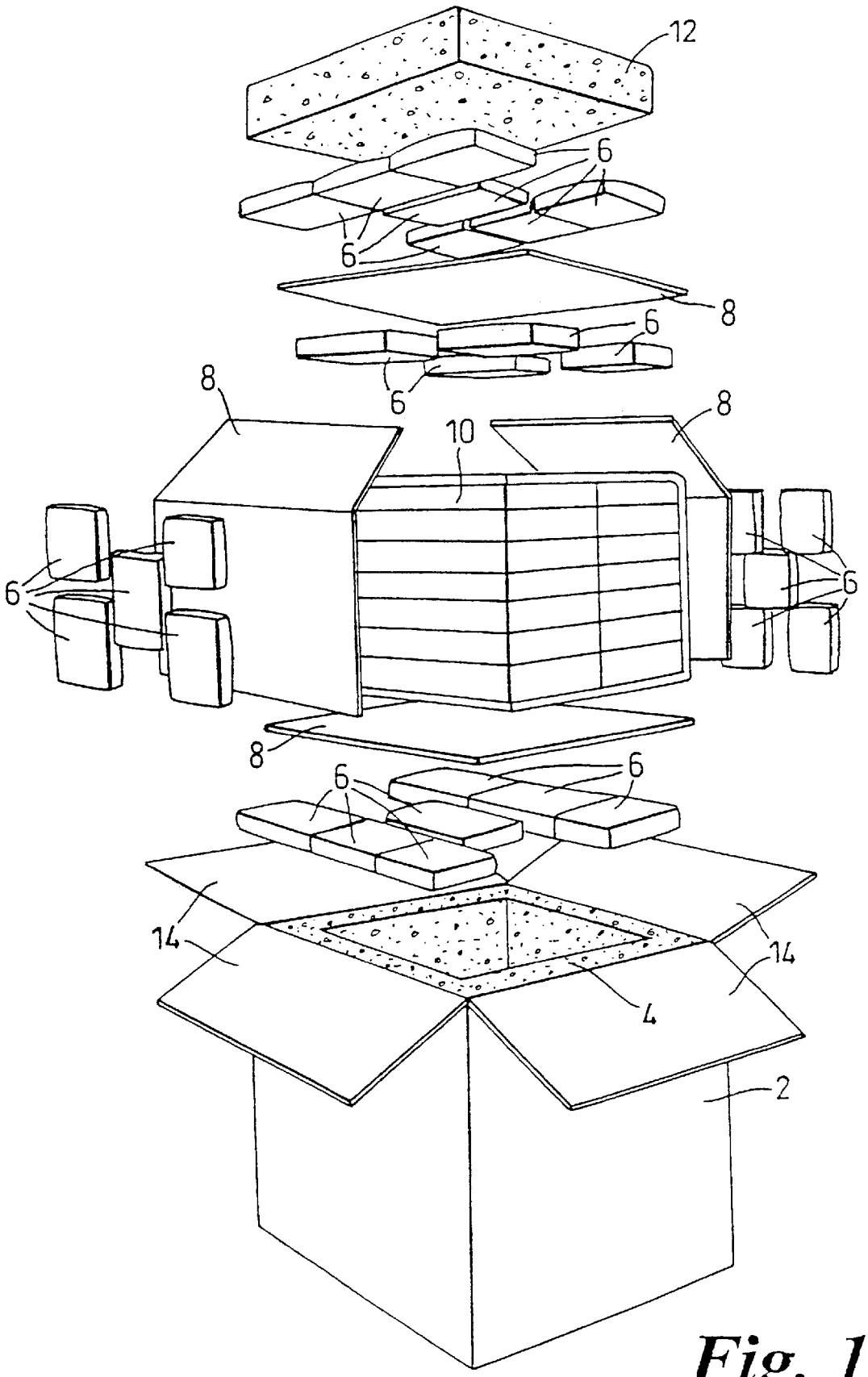
FIG. 1 is an exploded perspective view of a prior art insulated container.
Figure 4:
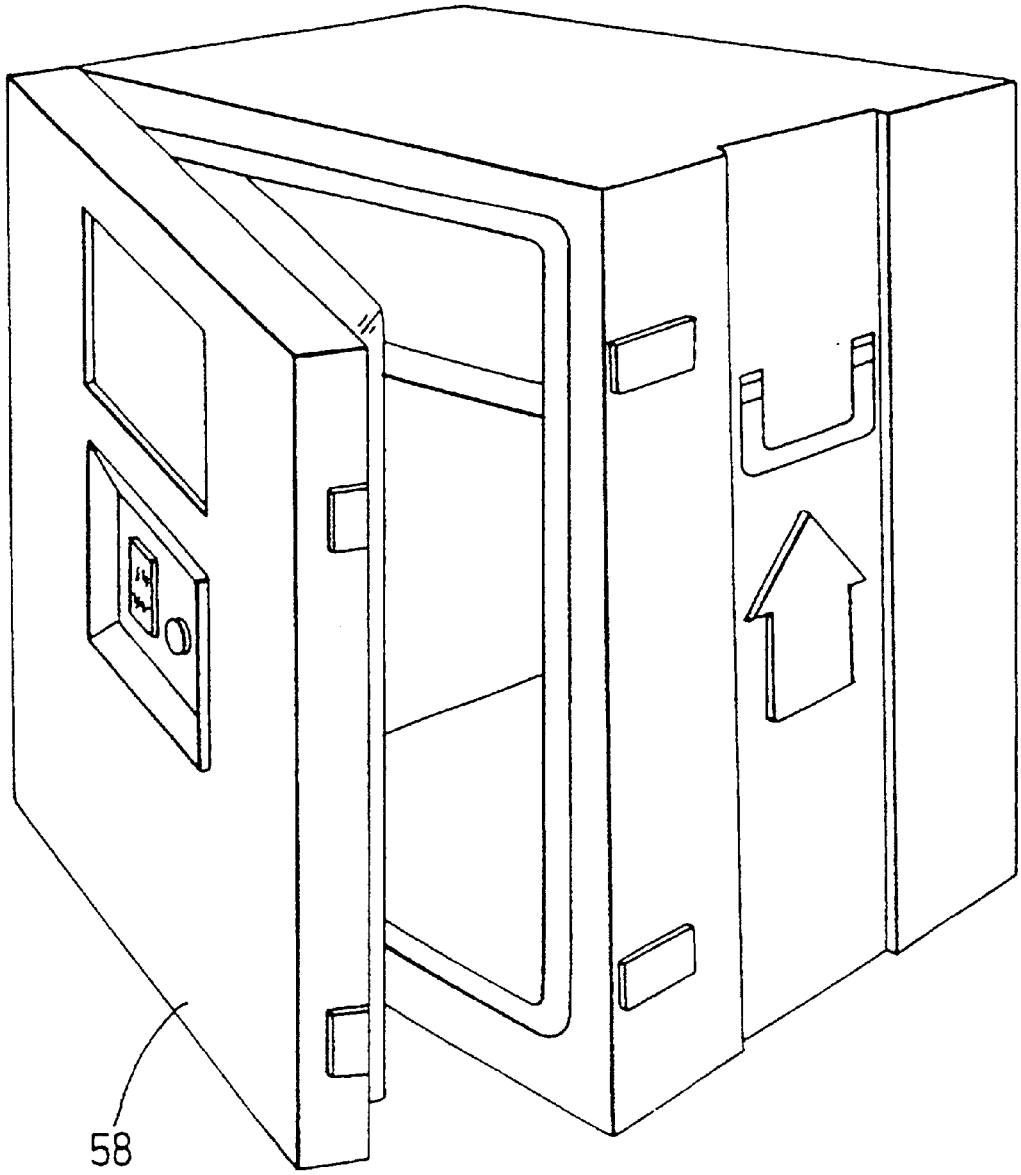

FIG. 4 is a perspective view of an insulated container according to a second embodiment of the invention The prior ant container shown in FIG. 1, which is known as an "SP box", is the type that is currently used for transporting temperature sensitive goods. The container consists of an outer box 2 of double skinned cardboard, which is lined on five sides with a thick layer of foamed insulating material 4. The bottom and the sides of the container are then lined with hot or cold "dogs" 6 which act as a heat reservoir and are designed to maintain the interior of the container at a predetermined temperature. There is an inner lining of thick cardboard 8, into which the product is placed, which is held in a number of trays 10. Further dogs 6 and card 8 are placed on top of the goods, followed by a thick foam lid 12. The top flaps 14 of the box are then closed and sealed.

The box 2 is not very durable and can normally only be used once. This creates waste and storage problems.

The number of dogs placed in the box is arrived at by educated guesswork, based on the anticipated delivery time and the ambient temperature ranges likely to be experienced during transportation. However, as delivery can take longer than anticipated and the ambient temperatures may be much higher or lower than expected, the internal temperature may go outside the required range, causing damage to the contents.

Figure 2:
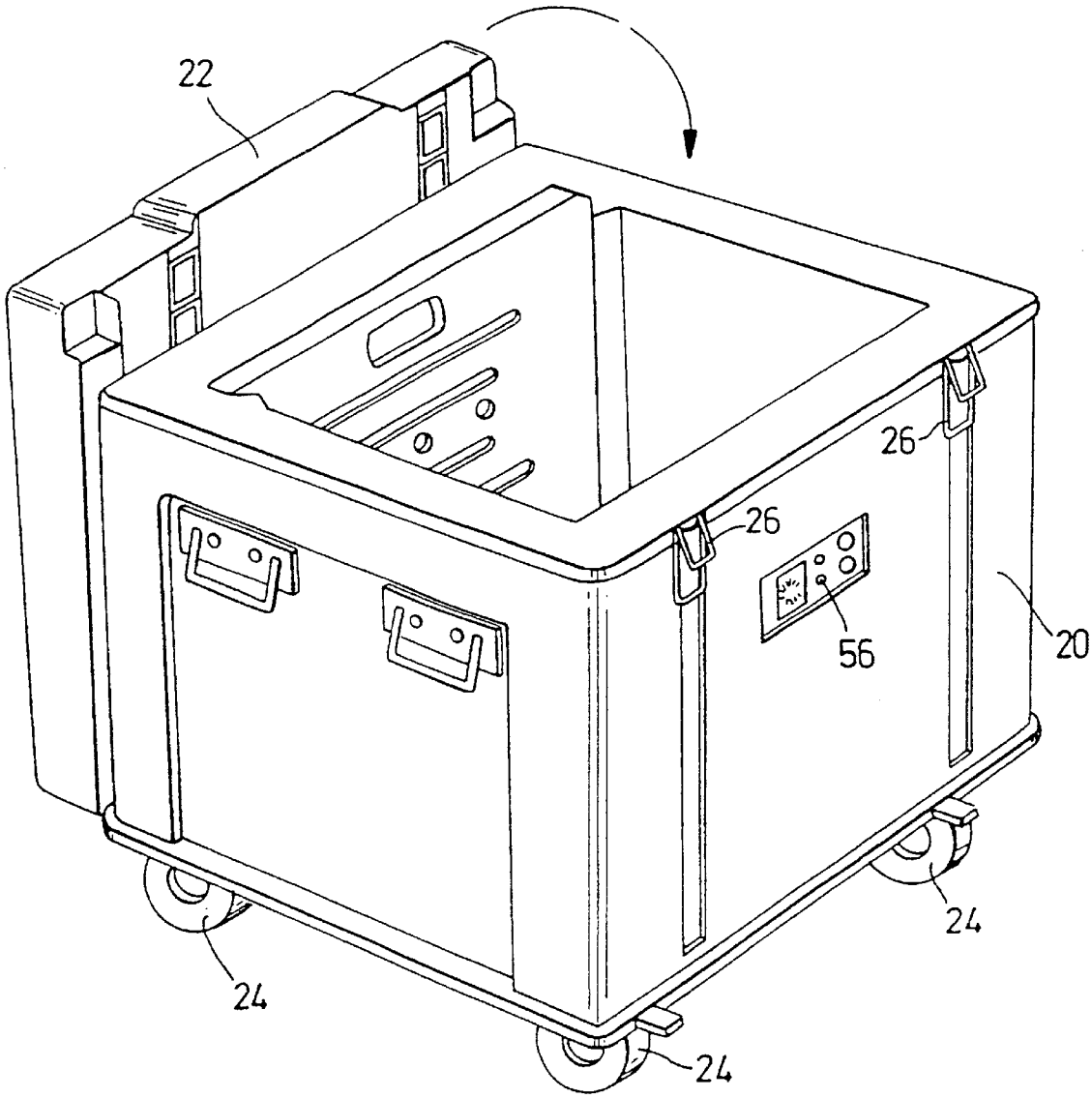
FIG. 2 is a perspective view of an insulated container according to a first embodiment of the invention.
Figure 3:
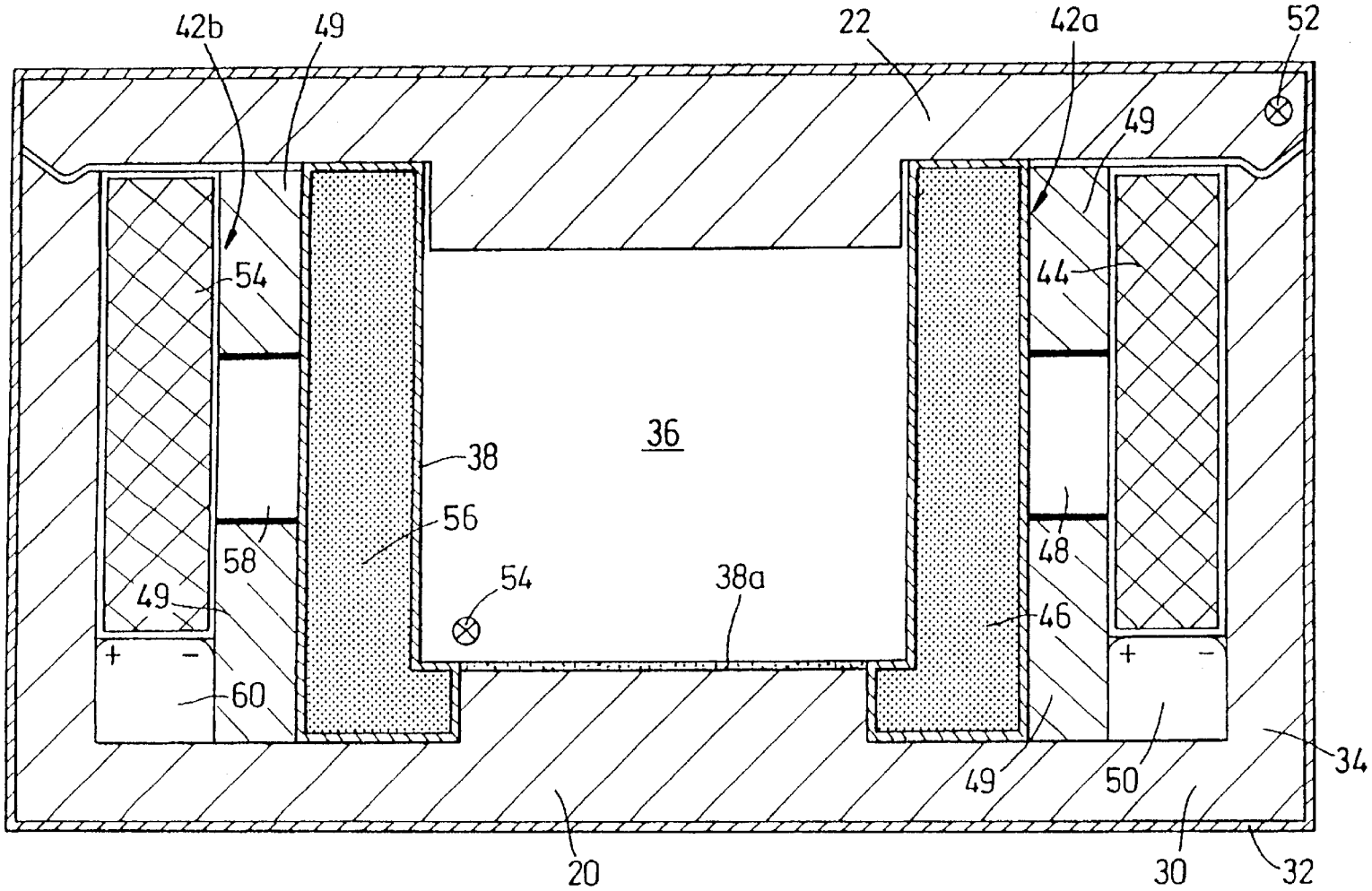
FIG. 3 is a cross-section through the container shown in FIG. 2.

An insulated container according to a first embodiment of the invention is shown in FIGS. 2 and 3. The container is in the form of a box 20 having a removable lid 2 and a set of castors 24 for ease of transport. A number of clips 26 are provided for securing the Lid 12 in place.

The components of the box are shown in cross section in FIG. 3. This box 20 is designed specifically for use in transporting goods that must be maintained at a temperature of between +2° C. and +8° C., such as, for example, vaccines and transplant organs. Boxes for different temperatures will be generally similar in construction, but may be modified as described in more detail below to maintain the required temperatures. For example, for some applications the internal temperature must be maintained in the range +20° C. to +31° C. whereas for other applications, the internal temperature must be maintained at approximately −87° C.

The box consists of a casing 30 that includes an outer shell 32 of, for example, glass reinforced plastic (GRP), metal or a plastics material. The casino has an inner liner 34 of insulating materials with a very high K value, for example a foamed plastics material. The lid 22, which has a sealing fit with the body of the box, has a similar construction.

The lid and the box are transparent to x-rays, at least in the vertical direction, allowing the box and its contents to be checked for security purposes at airports Without opening the box.

In the centre of the casing 30 there is provided a payload volume 36 which is defined by an inner shell 38 of for example stainless steel or aluminum. The bottom face 38*a* of the inner sheet may be made of a wire mesh, so that it is transparent to x-rays. The inner shell 38 is narrower than the internal width of the outer casing to provide on each side a space for a temperature control system 42, which in operation maintains the temperature in the payload volume in the predetermined temperature range.

The temperature control system consists of two parts: a cold side 42*a* for reducing the temperature in the payload area, and a hot side 42*b* for increasing the payload temperature. These are located on opposite sides of the casing 30.

The cold side of the system includes a cold dog 44 consisting of a frozen gel or similar material having a high value latent heat of fusion, which prior to use is frozen to a temperature of approximately −3° C. This cold dog serves as a heat sink for absorbing heat from the payload to reduce its temperature.

The cool side also includes a thermal gel 46 having a high specific heat capacity, which prior to use is heated or cooled to the desired temperature range. The thermal gel 46 is in thermal contact with the payload volume 36 and has an equal thermal mass to the cold dog 44. The gel serves as a thermal buffer between the cold dog and the payload volume, preventing rapid or localised heating or cooling of the items in the payload volume.

Mounted between the thermal gel 46 and the cold dog 44 is a control device 48 for controlling the flow of heat from the gel to the cold do. The control device provides a thermal conduction path between the gel and the cold dog and, apart from this control device, the cold dog is thermally insulated from the gel and the payload volume by means of insulating layer 49. The temperature control device nay, for example, be a Peltier cell having one junction in contact with the cold dog and the other in contact with the gel so that, by varying the current passed through the cell from a battery 50 the rate of heat flow into the cold dog can be increased or decreased. Alternatively, a mechanical temperature control device may be provided.

The hot side 42*b* of the temperature control system is similar to the cold side, and includes a hot dog 54 having a high specific heat capacity. The hot dog is heated or cooled to a temperature of +12° C. so that it acts as a heat reservoir that can provide heat to the cooler payload volume. The hot side of the system includes a thermal gel 56 which, before use, is heated or cooled to the desired payload temperature and a temperature control device 58 for controlling the flow of heat from the hot dog to the gel. This may be a Peltier cell, which is driven by a battery 60, or a mechanical temperature control device may be provided. The control device 58 provides a thermal conduction path between the gel 56 and the hot dog 54 and, apart from this control device, the hot dog is thermally insulated from the gel and the payload volume by means of insulating layer 49.

The box includes an external temperature sensor 52 mounted on the outside of the casing 30, and an internal temperature sensor 54, mounted inside the payload volume. These are connected to an electronic control unit (not shown), which controls the electric current flowing through the two temperature control devices 48,58 to control the rate of heat flow to and from the hot and cold dogs 54,44. In use, the electronic control device determines from the sensed internal and external temperatures and the known K value of the box the rate of heat flow into or out of the box. It uses this information to activate either the hot side or the cold side of the temperature control system to increase or decrease the rate of heat flow into or out of the payload volume, so as to maintain the payload at a constant temperature.

For example, if the external ambient temperature is high, heat will flow into the box from the outside, increasing the payload temperature. The electronic control device will sense the high ambient temperature and activate the cold side of the temperature control system so that heat is allowed to flow from the payload into the cold dog 44, thereby maintaining the payload in the desired temperature range. Conversely if the external temperature is low, heat will be lost from the box and the electronic control device will activate the hot side of the temperature control system, causing heat to flow from the hot dog 54 into the payload volume 36, to maintain the payload at the required temperature.

The electronic control device has a relatively long sampling interval of, for example 2 to 4 hours, so that it does not react immediately to sudden external temperature changes. This avoids wasting the heating and cooling effects of the hot and cold dogs when for example, the box is left in a warm or cold location for a relatively short time, which is insufficient to cause a large change in the payload temperature. This may occur for example when the container is placed in the hold of an aircraft that has to stand on a runway in full sun for some time before taking off. Since the effect of the high temperature experienced while the aircraft is standing on the runway is likely to be effectively cancelled by the much lower temperature experienced while the aircraft is flying at a high altitude, there is no need for the heating and cooling reserves of the dogs to be utilised to keep the internal temperature in the desired range.

The electronic control device operates by measuring the integrated rate of power transfer to and from the box, so that extra heating or cooling is provided only if heat lost or gained the box exceeds a predetermined amount, which will happen if the external temperature is very high or very low for prolonged periods. By integrating the rate of power transfer, the electronic control device takes account of both the magnitude of the temperature difference between the internal and external temperatures and also the time for which that external temperature is experienced. The energy transfer may be calculated in "units", equal to the product of temperature difference and time. For example, an external temperature 10° above the internal temperature for five hours (50 "units") will be cancelled out by an external temperature 5° below the internal temperature for ten hours (50 "units"), so requiring no use of the hot and cold dogs. On the other hand, an external temperature 20° above the internal temperature for ten hours (200 "units"), followed by 10° below for five hours (50 "units") will result in a net heat gain of 150 units, requiring use of the cold dog to maintain the desired temperature range.

A modified operating method may be adopted when the device is used for transporting live products, such as tissue cultures that are sustained on a nutrient-containing agar. As mentioned above, such products have to be maintained within a fairly narrow temperature range (typically 21–30C) to survive, but the rate at which they consume the nutrients in the agar also depends on the temperature, increasing as the temperature rises. Similarly, certain vaccines can be affected by bacteria, which grow at a rate that increases with temperature. Therefore, for maximum life, it is desirable to maintain the temperature inside the container as close as possible to the bottom end of the acceptable range. In such a case, the control algorithms of the electronic control device may be modified, so as to bias the temperature towards the lower end of the acceptable ranges while always staying within that range.

A single or multi-channel data logger 56 may be provided to maintain a record of the payload temperature during the entire transit time. This may use the internal temperature sensor 54, or a separate payload sensor may be provided. The temperature log may be kept in visual or electronic form, and in the latter case facilities may be provided for downloading the information telephonically or to a computer. The data logger may also record events such as the box being opened or tampered with.

In the case of a container that is to be used for transporting live cultures, the data logger may also be arranged to calculate from the temperatures recorded inside the container the rate at which the nutrients inside the agar have been consumed and, from that information, calculate and display the estimated remaining lifetime of the culture. Similarly, if the container is to be used for transporting vaccines, the data logger can calculate the rate of degradation, thereby increasing confidence that the vaccine will not have degraded unacceptably during transportation.

The heating or cooling capacity provided by the hot or cold dogs may be tailored according to the required internal temperature range and the anticipated external temperature range. For example, if the internal temperature must be maintained in the range +20° C. to +31° C. a larger heating capacity is likely to be required and it is possible that the cold dog may be omitted entirely. Conversely, if the internal temperature must be maintained at approximately −87° C., additional cooling capacity may be required and it may be possible to omit the hot dog entirely.

The substances chosen for the hot and cold dogs may also be tailored according to the desired temperature ranges so that their fusion temperatures are appropriate to the temperature range required.

An alternative embodiment of the in FIG. 4, in which the box has a hinged door 58 rather than a removable lid. Otherwise, the box is similar to the box shown in FIGS. 2 & 3.

Various modifications of the invention are possible, some examples of which are discussed below. The inner payload container may include shock absorbing materials to prevent vibration and movement of the materials being carried. For example., the payload container may include an inner liner such as an air bag, or sprung shelving. The data logger may record events such as the box being inverted, subjected to shock or any other factor of interest to the user. The box may be bar coded to carry information such as the payload carried, transit dates and any other information that may be required. The box may also be provided with visual and/or audible warning devices, for example to warn that the required temperature range has not been maintained. The batteries 50,60 may be provided with Zener barriers, to prevent a current overload if they are short-circuited.

What is claimed is:

1. A thermally insulated container comprising:

a payload volume located inside a sealed container, said payload volume to be maintained at a payload temperature within a predetermined temperature range during use;

heating means located in said sealed container comprising a first heat storage means adapted to be pre-heated to a temperature above said predetermined range, said first heat storage means being isolated from an ambient environment external to said sealed container;

cooling means located in said sealed container comprising a second heat storage means adapted to be pre-cooled to a temperature below said predetermined range, said second heat storage means being isolated from an ambient environment external to said sealed container;

a first thermal pathway located inside said sealed container between the payload volume and the first heat storage means, said first thermal pathway comprising means for transferring heat selectively from said first heat storage means to said payload volume to raise said payload temperature;

a second thermal pathway located inside said sealed container between the payload volume and the second heat storage means, said second thermal pathway comprising means for transferring heat selectively from said payload volume to said second heat storage means to lower said payload temperature; and control means for controlling flow of heat through the first and second thermal pathways to maintain said payload temperature within the predetermined range.

2. The container according to claim 1, wherein the control means comprises an external temperature sensor for measuring the ambient temperature.

3. The container according to claim 1, wherein the control means comprises an internal temperature sensor for measuring the temperature in the payload volume.

4. The container according to claim 2, wherein the control means extrapolates from the measured temperature the rate of transfer of heat to or from the container.

5. The container according to claim 1, wherein the control means comprises a thermoelectric device for controlling the flow of heat between the payload volume and the first heat storage means.

6. The container according to claim 1, wherein the first heat storage means comprises a first substance that liberates heat during use to the payload volume, and the second heat storage means comprises second substance for absorbing heat during use from the payload volume.

7. The container according to claim 1, wherein the first heat storage means comprises a first substance that changes state during use to liberate heat, and the second heat storage means comprises a second substance that changes state during use to absorb heat.

8. The container according to claim 1, wherein the control means biases the temperature in the payload volume towards a lower end of the predetermined range.

9. The container according to claim 1, further comprising a recording device for recording the temperature in the payload volume.

10. The container according to claim 9, wherein the recording device calculates from the recorded temperature a remaining lifetime of products transported in the payload volume.

11. The container according to claim 1, wherein the container has the form of a sealable, thermally insulated box.

12. The container according to claim 11, wherein the box is reusable.

13. The container according to clam 1, wherein the container is substantially transparent to x-rays in at least one direction.

14. The container according to claim 1, further comprising thermal insulating means for insulating at least one of the first heat storage means and the second heat storage means from the payload volume.

15. The container according to claim 3, wherein the control means extrapolates from the measured temperature the rate of transfer of heat to or from the container.

16. The container according to claim 1, wherein the control means comprises a thermoelectric device for controlling the flow of heat between the payload volume and the second heat storage means.

17. The container according to claim 1, further comprising:

a battery electronically connected to said control means for powering said control means independent from any external AC power source.

* * * * *